United States Patent [19]

Yang

[11] Patent Number: 5,057,003

[45] Date of Patent: Oct. 15, 1991

[54] GAS CANDLE

[76] Inventor: Chao-Ming Yang, No. 20, Lane 2, Kuang Wu Street, Pan Chao, Taipei Hsien, Taiwan

[21] Appl. No.: 686,519

[22] Filed: Apr. 17, 1991

[51] Int. Cl.[5] ..... F23Q 2/32

[52] U.S. Cl. ..... 431/125; 431/344; 362/161; 362/810

[58] Field of Search ..... 431/125, 126, 253, 344, 431/153, 288, 127, 142, 345, 277; 362/810, 161, 160, 381; 222/2; 126/401, 404, 409, 412, 413, 414

[56] References Cited

U.S. PATENT DOCUMENTS

| | | | |
|---|---|---|---|
| 2,984,093 | 5/1961 | Goddard et al. | 431/125 |
| 3,066,516 | 12/1962 | Falligant et al. | 431/125 |
| 3,169,387 | 2/1965 | Cordillo | 431/344 |
| 3,252,308 | 5/1966 | Goddard | 431/344 |
| 3,349,577 | 10/1967 | Burchett et al. | 431/126 |
| 3,360,967 | 1/1968 | Massie | 431/125 |
| 4,415,329 | 11/1983 | Dodd | 431/344 |

*Primary Examiner*—James C. Yeung

*Attorney, Agent, or Firm*—Fleit, Jacobson, Cohn, Price, Holman & Stern

[57] ABSTRACT

A gas candle, comprising a cylindrical casing divided by a division plate into a first chamber at the bottom for containing illuminating gas and a second chamber at the top for holding a gas flow rate control device. The division plate has a gas outlet hole at the center through which illuminating gas is permitted to discharge into the second chamber. The gas flow rate control device has an outer thread screwed up with the inner thread on the second chamber, a nozzle tip defining a gas passage way longitudinally piercing through the body of the gas flow rate control device, an annular groove on the periphery thereof at a lower end with an O-ring mounted thereon to seal the gap between the gas flow rate control device and the cylindrical casing. A sealing cover is mounted on the division plate at the top to seal the gas outlet hole. A pressure cushion is mounted on the seal cover at the top, having a pin at the top for inserting in the gas passage way of the gas flow rate regulating device from the bottom. By rotating the gas flow rate regulating device in the cylindrical casing in clockwise or counter-clockwise direction, gas flow rate through the gas outlet hole and the nozzle tip is controlled.

1 Claim, 2 Drawing Sheets

GAS CANDLE

BACKGROUND OF THE INVENTION

The present invention relates to candles and relates more particularly to such a candle that produces light by burning illuminating gas.

Conventional structure of candle is generally comprised of a cylindrical mass of tallow or wax with a wick through its center. When a candle is burned, the intensity of flame can not be reulated and, the tallow or was will be gradually melted to drop. During burning, dropping tallow or wax may scale one's hand easily and, exhaust gas may also cause air pollution. Further, a candle made of tallow or wax may be broken or bent to deform easily.

SUMMARY OF THE INVENTION

The present invention has been accomplished to eliminate the aforesaid problems. It is therefore an object of the present invention to provide a gas candle which produces light by burning illuminating gas through complete combustion without causing air pollution. Another object of the present invention is to provide a gas candle which is durable in use and can be controlled to regulate the intensity of light.

According to the present invention, there is provide a gas candle generally comprised of a cylindrical casing having a gas chamber for containing illuminating gas, a sealing cover covering over said gas chamber to seal a gas outlet hole made on the top center of said gas chamber, a pressure cushion mounted on said sealing cover at the top, a gas flow rate regulating device fastened in said cylindrical casing through screw joint which has a gas passage way through the central axis thereof, an O-ring mounted on said gas flow rate regulating device to seal the gap between said gas flow rate regulating device and said cylindrical casing, and a top cap covering over said gas flow rate regulating device. Gas flow rate discharging through the gas outlet hole and the gas passage way is controlled by turning the gas flow rate regulating device up and down in the cylindrical casing.

Figure 1:
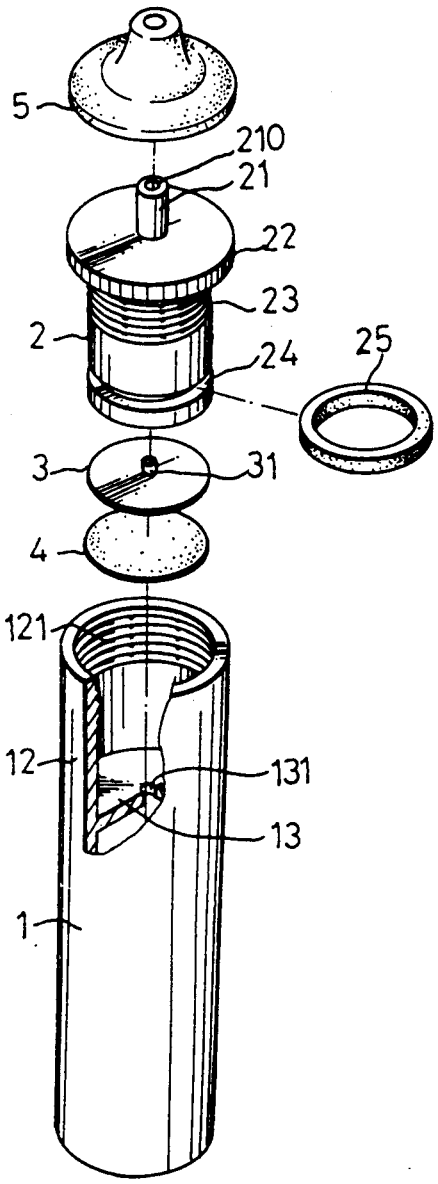
FIG. 1 is an exploded perspective view of a gas candle embodying the present invention.
Figure 2:
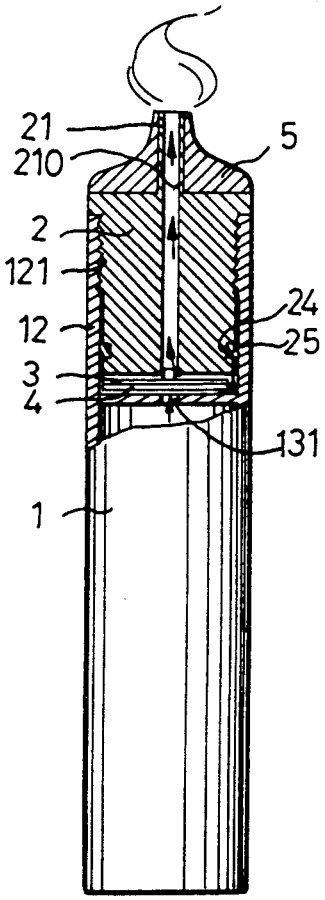
FIG. 2 is a sectional assembly view thereof.

DETAILED DESCRIPTION OF THE PREFERRED EMBODIMENTS:

Referring to FIGS. 1 and 2, there is shown a candle constructed according to the present invention which is generally comprised of a cylindrical casing 1, a gas flow rate regulating device 2, a pressure cushion 3, a sealing cover 4 and a top cap 5. The cylindrical casing 1 is provided for containing illuminating gas, having a cylindrical top extension 12 peripherally extending upwards from the top face 13 thereof. The top face 13 of the cylindrical casing 1 has a gas outlet hole 131 at the center for discharging of internal illuminating gas out of the cylindrical casing 1 for burning. The cylindrical top extension 12 has an inner thread 121 on the inner wall surface thereof and defines therein a holding space for holding the gas flow rate regulating device 2, the pressure cushion 3 and the sealing cover 4. The sealing cover 4 is mounted on the top face 13 to seal the gas outlet hole 131. The pressure cushion 3 is mounted on the top of the sealing cover 4 and squeezed by the gas flow rate regulating device 2 to force the sealing cover 4 to seal the gas outlet hole 131, having a pin 31 upstanding therefrom at the center. The gas flow rate regulating device 2 is made in cylindrical shape, having a projecting rim 22 at one end, a nozzle tip 21 disposed at the top and defining therein a gas passage way 210 longitudinally piercing through the body of the gas flow rate regulating device 2, an outer thread 23 around the periphery thereof, and an annular groove 24 around the periphery thereof at a lower location for mounting an O-ring 25. The top cap 5 is made from tallow or wax in any of a variety of shapes, having a center hole for inserting the nozzle tip 21 of the gas flow rate regulating device 2.

During assembly, the sealing cover 4 is mounted on the top face 13 of the cylindrical casing 1 and the pressure cushion 3 is then mounted on the top of the sealing cover 4. After an O-ring 25 is mounted on the annular groove 24, the gas flow rate regulating device 2 is fastened in the cylindrical top extension 12 of the cylindrical casing 1 with the outer thread 23 thereof screwed up with the inner thread 121 of the cylindrical top extension 12, permitting the O-ring 25 to seal the gap between the inner wall surface of the cylindrical top extension 12 of the cylindrical casing 1 and the outer wall surface of the gas flow rate regulating device 2 and, permitting the pin 31 of the pressure cushion 3 to insert in the bottom end of the gas passage way 210. As soon as the top cap 5 is mounted on the nozzle tip 21 to cover over the projecting rim 22 of the gas flow rate regulating device 2, the whole assembly of the candle is well set up.

Operation of the present invention is outlined hereinafter. Turning the gas flow rate regulating device 2 upwards relative to the cylindrical top extension 12 permits illuminating gas to discharge out of the cylindrical casing 1 through the gas outlet hole 131 (because pressure is released from the pressure cushion 3 and sealing cover 4). Because the gap between the cylindrical top extension 12 and the gas flow rate regulating device 2 is sealed by the O-ring 25, discharged illuminating gas from the cylindrical casing 1 immediately flows into the gas passage way 210 to further discharge out of the gas flow rate regulating device 2 through the nozzle tip 21 and the center hole of the top cap 5 for burning. When illuminating gas is burned at the top of the top cap 5, the top cap 5 is soon melted to drop permitting dripping tallow or wax to irregularly hang from the periphery of the cylindrical top extension 12. When the gas flow rate regulating device 2 is tightly fastened in the cylindrical casing 1, it gives a pressure to force the sealing cover 4 to seal the gas outlet hole 131 via the pressure cushion 3. Therefore, by turning the gas flow rate regulating device 2 up and down relative to the cylindrical casing 1, the intensity of flame is controlled.

Figure 3:
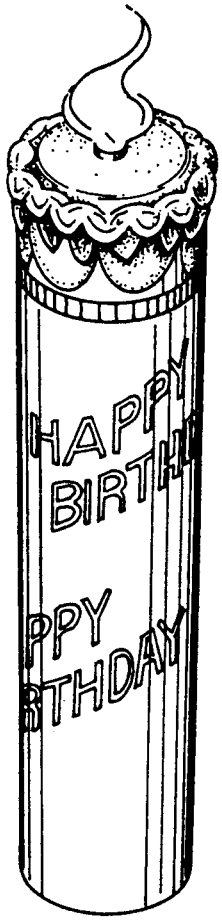
FIG. 3 illustrates an alternate form of the present invention.
Figure 4:
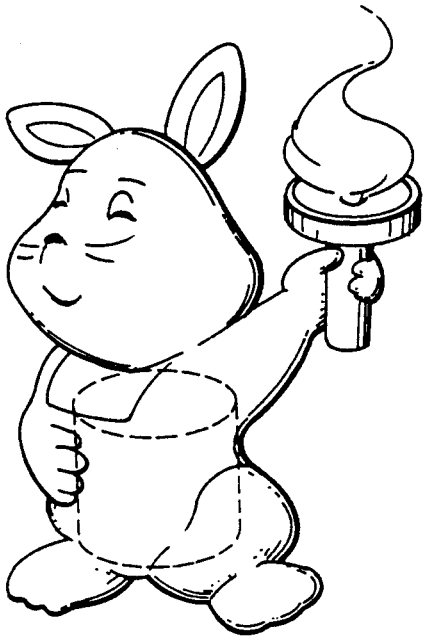
FIG. 4 illustrates another alternate form of the present invention.

Referring to FIGS. 3 and 4, the present invention may be made in any of a variety of shapes so as to attract people to buy.

What is claimed is:

1. A gas candle, comprising:

a casing having a division plate dividing the holding space thereof into an enclosed gas chamber at the bottom for containing illuminating gas and a cylindrical control chamber at the top, said division plate having a gas outlet hole permitting illuminating gas to discharge from said enclosed gas chamber into said control chamber, said control chamber having an outer thread portion;

a sealing cover placed on said division plate at the top, to seal said gas outlet hole;

a pressure cushion placed on said sealing cover at the top, having a pin vertically projecting upwards at the center;

a gas flow rate regulating device comprising a cylindrical body set in said control chamber, said cylindrical body having nozzle tip disposed at the top and defining therein a gas passage way longitudinally piercing through said cylindrical body, an outer thread portion on the outer wall surface thereof screwed up with said inner thread portion of said control chamber, an annular groove around the outer wall surface thereof at a position below said outer thread portion, and an O-ring mounted on said annular groove to seal the gap between said cylindrical body and said control chamber; and wherein said gas flow rate regulating device can be screwed upwards in said control chamber to regulate illuminating gas flow rate discharging out of said cylindrical casing through said nozzle tip or screwed downwards in said control chamber to drive said pressure cushion to force said sealing cap to seal said gas outlet hole.

* * * * *